US005251823A

United States Patent [19]

Joshi et al.

[11] Patent Number: 5,251,823

[45] Date of Patent: Oct. 12, 1993

[54] ADJUSTABLE ATOMIZING ORIFICE LIQUID FUEL BURNER

[75] Inventors: Mahendra L. Joshi, Altamonte Springs; Paul O'Connor, Ocoee, both of Fla.

[73] Assignee: Combustion Tec, Inc., Apopka, Fla.

[21] Appl. No.: 927,331

[22] Filed: Aug. 10, 1992

[51] Int. Cl.[5] ..... B05B 7/10

[52] U.S. Cl. ..... 239/401; 239/406

[58] Field of Search ..... 239/401, 403, 404; 431/9, 182, 183

[56] References Cited

U.S. PATENT DOCUMENTS

| | | | |
|---|---|---|---|
| 3,448,925 | 6/1969 | Cross | 239/403 |
| 3,576,384 | 4/1971 | Peczeli et al. . | |
| 3,700,173 | 10/1972 | Ketchum, Jr. . | |
| 3,733,169 | 5/1973 | Lefebvre . | |
| 3,904,119 | 9/1975 | Watkins . | |
| 4,201,538 | 5/1980 | Kopp . | |

FOREIGN PATENT DOCUMENTS

| | | | |
|---|---|---|---|
| 597071 | 8/1959 | Italy | 239/404 |
| 392030 | 5/1933 | United Kingdom | 239/404 |
| 693997 | 7/1953 | United Kingdom | 239/401 |

*Primary Examiner*—Carroll B. Dority

*Attorney, Agent, or Firm*—Speckman, Pauley & Fejer

[57] ABSTRACT

An adjustable atomizing orifice liquid fuel burner having two distinct mechanisms for changing flame characteristics, the first of which involves changing the liquid fuel spray pattern exiting the fuel nozzle and the second of which involves adjusting the atomizing medium flow properties out of the atomizing venturi. A liquid fuel tubular member having a liquid fuel tip sealingly connected to the outlet end thereof is concentrically disposed within an atomizing fluid tubular member, the atomizing fluid outlet end of which forms a venturi. The liquid fuel tip is adjustable in a longitudinal direction within the venturi formed by the atomizing fluid outlet end of the atomizing fluid tubular member. The liquid fuel tip further comprises means for imparting a swirl to the liquid fuel as it exits the liquid fuel tip.

9 Claims, 3 Drawing Sheets

ADJUSTABLE ATOMIZING ORIFICE LIQUID FUEL BURNER

BACKGROUND OF THE INVENTION

1. Field of the Invention

This invention relates to liquid fuel burners, in particular, adjustable atomizing orifice liquid fuel burners.

2. Description of the Prior Art

A frequently encountered problem for operators of combustion heated high temperature furnaces, such as glass melters, is the need to adjust the rate of fuel consumption in line with the production requirements, in particular, the output, of such furnaces. For example, at reduced output, firing rate must also be reduced. Within a given furnace having a fixed melting area, combustion volume, and burner location, conformance of the liquid fuel flame length, shape and momentum to the firing rate and load distribution within the furnace is essential for an efficient furnace operation. Thus, it is important to be able to adjust the flame characteristics at a given firing rate to provide efficient furnace operation. In most liquid fuel burner applications, the flame length, shape and momentum can be significantly adjusted by altering the degree of liquid fuel atomization. Altering the degree of atomization not only improves furnace thermal efficiency, but also increases both product quality and productivity. In addition, alteration of flame gas momentum prevents undesirable flame impingement upon the refractory of the furnace, excessive particulate entrainment and non-uniform temperature profiles which lead to hot spots and uneven heat distribution within the furnace.

Known methods for altering the degree of atomization to achieve desired flame characteristics, although simple, are nevertheless impractical. Such methods include replacement of fixed area atomizers or nozzles depending on the need to increase or decrease the atomizing fluid momentum with atomizers or nozzles having the appropriate flow geometry or area for the desired atomizing fluid momentum.

Another known method for altering the degree of atomization for achieving desired flame characteristics involves controlling the upstream pressure to the atomizer. Such pressure can be controlled by a limiting orifice valve upstream of the atomizer across which a pressure drop is taken, which pressure drop can be altered by opening and closing the valve. The change in upstream pressure to the atomizer results in a change in momentum of the atomizing fluid and, thus, shearing action for atomization between the atomizing fluid and the liquid fuel. However, this method also results in a change in the total flow rate of atomizing fluid which may not be desirable for certain grades of liquid fuels or for certain firing rates.

In addition, altering the degree of atomization to achieve certain desired flame characteristics either by changing atomizers or changing the upstream pressure of the atomizing fluid as discussed above is inefficient and time consuming. Both such methods require interruption of the process during the changeover of nozzles or the changes in upstream pressure depending on the desired firing rate or flame characteristics. Furthermore, specifically with respect to fixed area atomizing nozzles, conventional liquid fuel atomizers using such nozzles are generally designed to operate optimally near design operating conditions. At or near design conditions, the atomizing fluid flow rate and velocity at the atomizing section offer the greatest shearing action to the liquid fuel. The resulting atomization of liquid fuel having a specific droplet size distribution corresponds directly to the desired flame characteristics. Thus, any deviation from the design conditions, such as changes in atomizing fluid mass flow rate, pressure or temperature, results in poor atomization.

Off design firing rates of liquid fuel burner having fixed area atomizers cause other serious problems as well. For example, such operation can result in liquid fuel dripping and subsequent carbon formation or plugging of the fuel nozzle at which point the flame becomes unstable and deflects, directly impinging on furnace refractories, thereby damaging the refractories and shortening the furnace life. In addition, the improper flame length and shape resulting from such operation disturbs furnace temperature profile which in turn increases the total cost of heating the furnace load.

Finally, known burners have a single fuel injection configuration which restricts the burner applicability to a certain furnace size, firing rate and load distribution. No single nozzle geometry is capable of handling most furnace heating conditions. As a result, separate nozzle designs based on a particular heating application are required.

U.S. Pat. No. 4,201,538 teaches a large burner for liquid fuels capable of operating under both full load and partial load conditions having a fuel supply pipe concentrically disposed within an air supply pipe and partially enclosed by a sleeve carrying the air. The fuel supply pipe is enclosed by a swirl producing body in the form of a fixed blower wheel. The fuel supply pipe is also provided with a spray diffuser which is enclosed by a sleeve forming a passage around the fuel supply pipe through which spray diffuser air flows. Disposed between the swirl producing body and the air supply tube are two additional air supply pipes. A sliding link is provided on the fuel supply pipe which permits interruption of the air supply to the swirl producing body and an annular gap between the two additional air supply pipes when the burner is operated under partial load conditions.

U.S. Pat. No. 3,904,119 teaches an air/fuel spray nozzle in which fuel is directed radially outward from a central housing of the nozzle into helical passages formed between the central housing and outer wall of the nozzle. Air passing through the helical passages mixes with the fuel such that a uniformly distributed air/fuel mixture exits from the nozzle into the surrounding area.

To improve the combustion efficiency of a liquid fuel burner, U.S. Pat. No. 3,576,384, U.S. Pat. No. 3,733,169 and U.S. Pat. No. 3,700,173 all teach the use of swirled air for atomizing a liquid fuel discharged from a nozzle centrally disposed within an air supply pipe through which the swirled air is supplied. The '384 patent teaches an oil burner assembly in which combustion air first enters an air chamber in which the air is rotated and then passes through a nozzle around a fuel atomizer into a combustion chamber; the '169 patent teaches a flame retention head assembly for use in the air tube of a fuel burner using oil or gas in which turbulence in the air exiting from the air tube is produced by a spinner plate disposed within a cylindrical ring downstream of the outlet of the fuel nozzle; and the '173 patent teaches a diffuser for liquid fuel fired burners having widely spaced slots formed in a frusto-conical surface positioned in the path of the combustion air to cause the combustion air to intersect the atomized liquid fuel spray as independent streams to accomplish a more complete mixing thereof over a wider burner operating range.

SUMMARY OF THE INVENTION

It is one object of this invention to provide an atomizing liquid fuel burner which can be adjusted to achieve desired flame characteristics at a given firing rate.

It is another object of this invention to provide an atomizing liquid fuel burner which can be adjusted to achieve flame characteristics at a given firing rate without changing atomizers or nozzles.

It is yet another object of this invention to provide an atomizing liquid fuel burner capable of operating over a full range of firing rates required by a given furnace without operational problems encountered by known liquid fuel burners operating at off-design firing rates.

It is yet another object of this invention to provide an atomizing liquid fuel burner having a plurality of fuel injection configurations.

These and other objects are achieved by an adjustable atomizing liquid fuel burner in accordance with one embodiment of this invention comprising a liquid fuel tubular member having a fuel inlet end and a fuel outlet end, an atomizing fluid tubular member concentrically disposed around the liquid fuel tubular member forming an annular chamber around the liquid fuel tubular member, a liquid fuel tip connected to the fuel outlet end of the liquid fuel tubular member and means for imparting a swirl to the liquid fuel disposed in the liquid fuel tip. The atomizing fluid tubular member has an atomizing fluid inlet end and an atomizing fluid outlet end, the atomizing fluid outlet end of the atomizing fluid tubular member forming a venturi. The liquid fuel tip connected to the fuel outlet end of the liquid fuel tubular member is disposed upstream of the atomizing fluid outlet and adjustable in a direction along a longitudinal axis of the liquid tubular member within the venturi. The liquid fuel tip converges externally toward the atomizing fluid outlet end of the atomizing fluid tubular member. Thus, as the liquid fuel tip is adjusted in said longitudinal direction within said venturi, the cross-sectional area of the annulus formed by the liquid fuel tip and the venturi is altered, changing the flow characteristics of the atomizing fluid through the venturi.

In accordance with one embodiment of this invention, the means for imparting a swirl to the liquid fuel comprise a spinner disposed within a liquid fuel tip upstream of an internal convergence of the liquid fuel tip towards the atomizing fluid outlet of the atomizing fluid tubular member. This inner convergence of the liquid fuel tip, hereinafter called a swirl chamber, is upstream of a straight exit length formed by the liquid fuel tip.

The spinner is designed based on liquid fuel flow capacity and desired spray pattern. A predetermined number, size and angle of axial-tangential borings are provided in the spinner which convert the available pressure energy in the liquid fuel upstream of the spinner into kinetic energy by producing several high velocity spinning jets downstream of the spinner. These liquid fuel jets enter the swirl chamber inside the liquid fuel tip. Due to the gradual reduction in swirl chamber diameter toward the atomizing fluid outlet end of the atomizing fluid tubular member, that is, in the direction of flow of the liquid fuel, the swirl of the liquid fuel increases. As the rotational velocity of the liquid jets increases based upon the principle of angular momentum, they merge with each other on the inside surface of the swirl chamber forming a very thin revolving film which exits the liquid fuel tip in the shape of a hollow cone. Medium pressure atomizing fluid, preferably air at less than about 80 psig, is introduced into the annular chamber between the liquid fuel tubular member and the atomizing fluid tubular member proximate the atomizing fluid inlet end of the atomizing fluid tubular member and exits at relatively high shearing velocity through the variable exit area formed by the liquid fuel tip in the venturi. This variable exit area, or adjustable atomizing orifice area, depending on atomizing medium pressure, can be set to a critical area which would provide a sonic velocity for the atomizing medium, if necessary. Generally, a very high kinetic energy atomizing medium impacts the hollow cone liquid fuel stream and breaks it into small droplets suitable for combustion. The atomized mixture having a desired droplet size distribution is transported into the combustion zone for mixing with combustion air and for formation of a flame having the desired length, shape and heat release rate and profile. Thus, the atomizing liquid fuel burner in accordance with this invention comprises two distinct mechanisms for changing flame characteristics, namely, means for changing the liquid fuel spray pattern exiting the fuel nozzle and means for adjusting the atomizing medium flow properties out of the atomizing venturi.

BRIEF DESCRIPTION OF THE DRAWINGS

These and other features of this invention will be better understood from the following detailed description in conjunction with the figures wherein.

DESCRIPTION OF PREFERRED EMBODIMENTS

Figure 1:
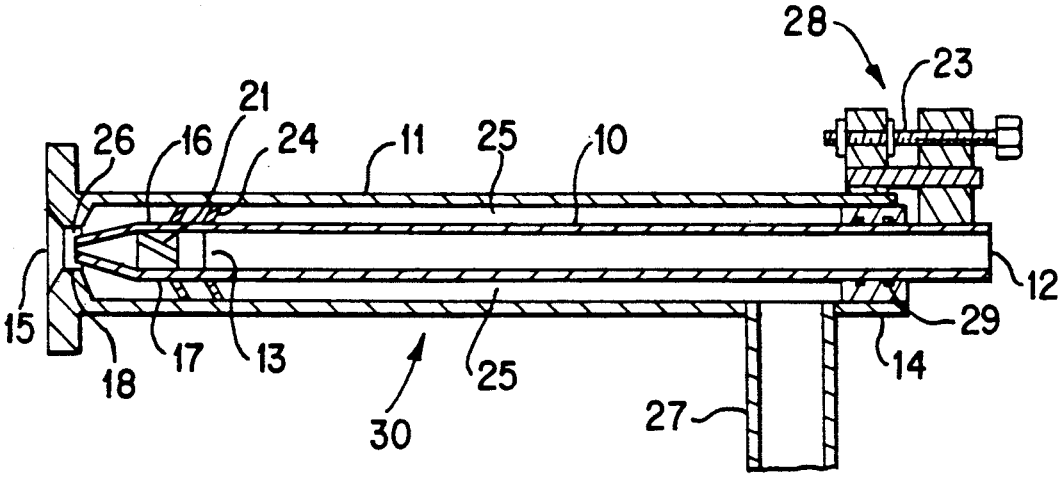
FIG. 1 is a cross-sectional side view of an atomizing liquid fuel burner in accordance with one embodiment of this invention.

An adjustable atomizing liquid fuel burner in accordance with one embodiment of this invention is shown in FIG. 1. Burner 30 comprises liquid fuel tubular member 10 having liquid fuel inlet end 12 and liquid fuel outlet end 13 concentrically disposed within atomizing fluid tubular member 11 forming annular chamber 25 around liquid fuel tubular member 10 Liquid fuel tip 16 is connected to fuel outlet end 13 and is disposed upstream of atomizing fluid outlet end 15 of atomizing fluid tubular member 11, atomizing fluid outlet end 15 forming venturi 18. Liquid fuel tip 16 is adjustable in a direction along the longitudinal axis of liquid fuel tubular member 10. In particular, liquid fuel tip 16 is adjustable in said longitudinal direction within venturi 18, altering the cross-sectional area of annular ring 26 formed by liquid fuel tip 16 in venturi 18. Accordingly, atomizing fluid introduced through atomizing fluid inlet 27 into atomizing fluid inlet end 14 of atomizing fluid tubular member 11 flows through annular chamber 25 past locator fins 24 and through annular ring 26. By altering the cross-sectional area of annular ring 26 by disposition of liquid fuel tip 1 within venturi 18, the velocity and flow rate of the atomizing fluid flowing through annular ring 26 can be controlled. Disposition of liquid fuel tip 16 within venturi 18, in accordance with one embodiment of this invention, is accomplished by adjustment mechanism 28 comprising adjusting lead screw 23. Adjustment mechanism 28 is connected to liquid fuel tubular member 10 and atomizing fluid tubular member 11 such that turning of adjusting lead screw 23 results in relative longitudinal movement between liquid fuel tubular member 10 and atomizing fluid tubular member 11. To prevent leakage of atomizing fluid, liquid fuel tubular member is sealingly secured at atomizing fluid inlet end 14 of atomizing fluid tubular member 11 within atomizing fluid tubular member 11, sealing provided by O-rings 29 or other suitable means. It will be apparent to those skilled in the art that disposition of liquid fuel tip 16 in venturi 18 can be accomplished by other suitable means.

To provide the desired liquid fuel spray pattern, liquid fuel tip 16 is provided with spinner 17 having axial-tangential boring 21 through which liquid fuel flowing through liquid fuel tubular member 10 passes, resulting in conversion of the available pressure energy in the liquid fuel upstream of spinner 17 into kinetic energy by producing high velocity spinning jets downstream of spinner 17.

Figure 2:
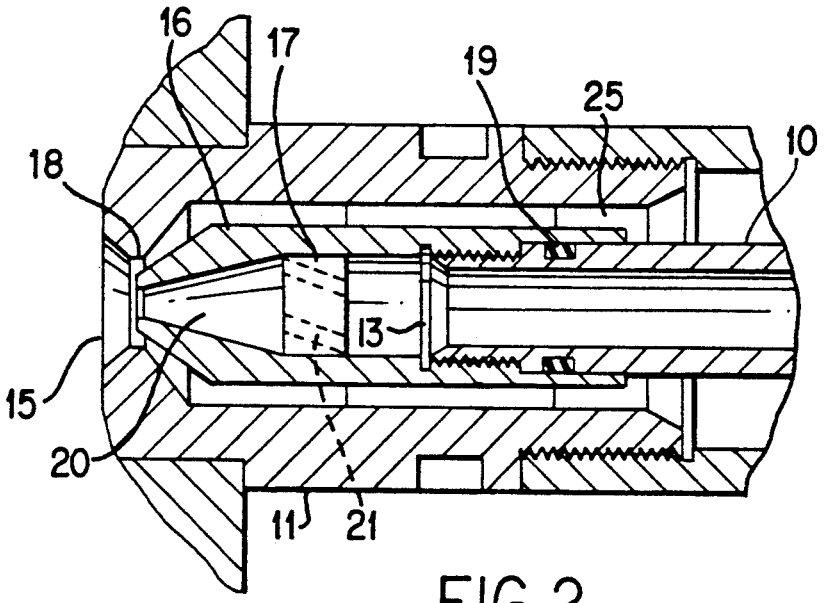
FIG. 2 is an enlarged cross-sectional view of the liquid fuel tip and venturi of the atomizing liquid fuel burner in accordance with one embodiment of this invention shown in FIG. 1.
Figure 3:
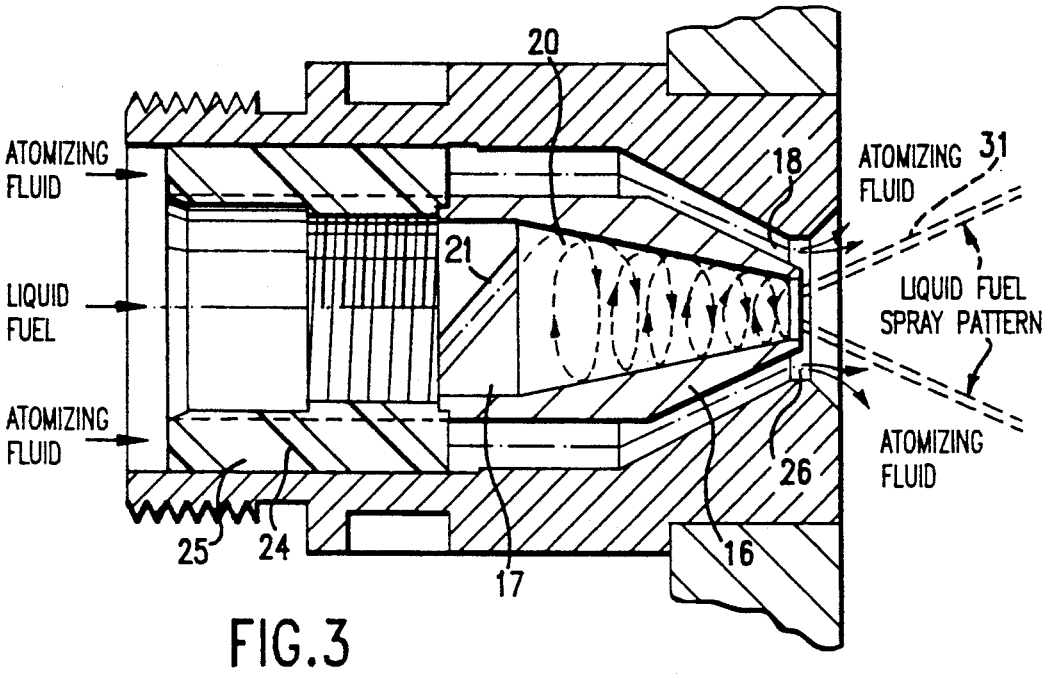
FIG. 3 is a partial cross-sectional side view of a venturi, liquid fuel tip, and spinner in accordance with one embodiment of this invention showing the liquid fuel and atomizing medium flow configuration.

In the enlarged view shown in FIG. 2, liquid fuel tip 16 is shown disposed within venturi 18 formed by atomizing fluid tubular member 11 at atomizing fluid outlet end 15. Spinner 17 is shown having a plurality of axial-tangential borings 21 which produce a plurality of high velocity spinning jets downstream of spinner 17. To further promote atomization of the liquid fuel, liquid fuel tip 16 forms swirl chamber 20 downstream of spinner 17, swirl chamber 20 converging in the direction of atomizer fluid outlet end 15. Thus, the high velocity spinning liquid fuel jets enter swirl chamber 20 in which the gradual reduction in swirl chamber 20 diameter in the direction of flow of the liquid fuel based on internal convergence of swirl chamber 20 toward atomizing fluid outlet end 15 increases the swirl of liquid fuel. As the rotational velocity of liquid jets increases, based on the principle of angular momentum, the liquid jets merge with each other on the inside surface of swirl chamber 20 forming a very thin revolving film which exits liquid fuel tip 16 in the shape of a hollow cone as shown in FIG. 3. To prevent leakage of liquid fuel into annular chamber 25 from liquid fuel tip 16, liquid fuel tip 16 is sealingly secured to liquid fuel outlet end 13 of liquid fuel tubular member 10, sealing provided by liquid fuel tip seal 19, preferably in the form of an O-ring.

To maintain liquid fuel tubular member 10 concentrically disposed within atomizing fluid tubular member 11, locator fins 24 are provided.

Medium pressure atomizing fluid, which fluid may be oxygen, steam or any gaseous substance, preferably air, enters annular chamber 25 created by locator fins 24 at atomizing fluid inlet end 14 and exits annular chamber 25 at relatively high shearing velocity through variable area annular ring 26 as shown in FIG. 3. This variable area annular ring 26, or adjustable atomizing orifice area, depending on atomizing fluid pressure, can be set to a critical area which would provide a sonic velocity for the atomizing medium, if necessary. Generally, a very high kinetic energy atomizing fluid impacts hollow cone liquid fuel stream 31 and breaks into small droplets suitable for combustion. In addition, the atomized mixture having a desired droplet size distribution is transported into the combustion zone of the furnace for mixing with combustion air, forming a flame having the desired length, shape and heat release rate.

Figure 4:
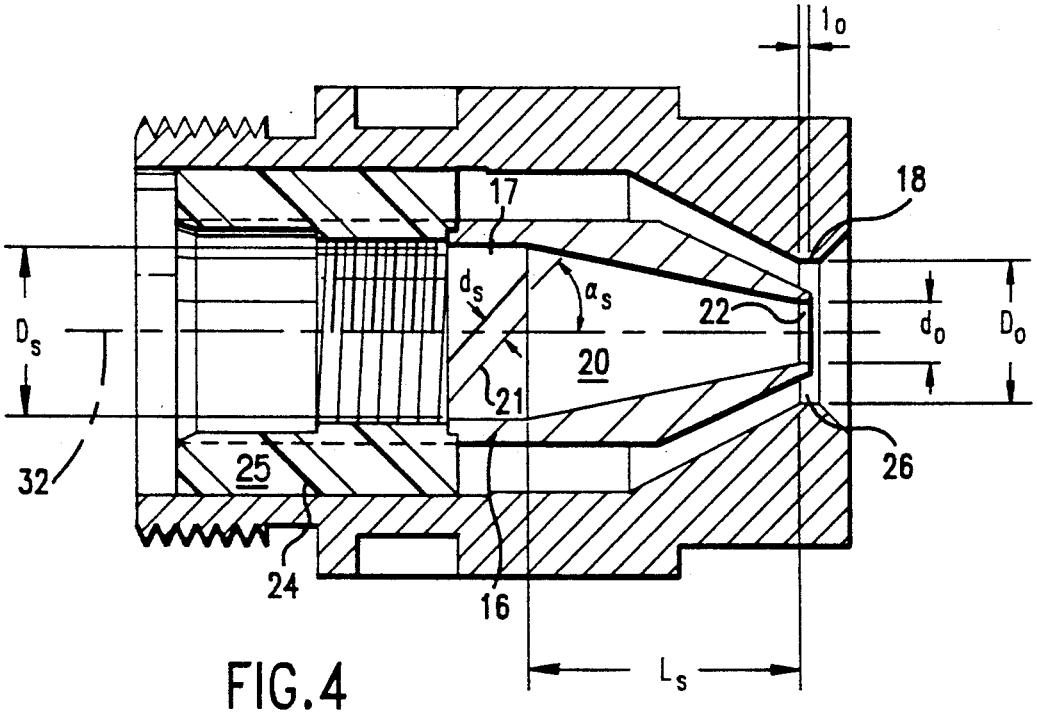
FIG. 4 is a partial cross-sectional side view of the venturi, liquid fuel tip and spinner shown in FIG. 3 with critical dimension notations.

Critical dimensional notations for venturi 18, liquid fuel tip 16, and spinner 17 are shown in FIG. 4. Extensive experiments carried out to determine the effects of individual dimensions on the overall atomization and flame characteristics of liquid fuel, in particular, fuel oil, burned in accordance with this invention have produced the preferred range of critical dimensions and their ratios required for operation inside a high temperature furnace as shown in Table 1.

TABLE 1

| OIL FLOW RATE (GPH) | LIQUID FUEL TIP (16) FIRING RATE (MM BTU/HR) | $\frac{D_s}{d_o}$ | $\frac{L_s}{D_s}$ | $\frac{l_o}{d_o}$ | SPINNER (17) HOLE DIA. ($d_s$) | NO. OF HOLES | TANG-AXIAL ANGLES ($\alpha_s$) |
|---|---|---|---|---|---|---|---|
| 4.4–130 | 0.5–20 | (2–4) | (1–2) | (0.1–0.2) | 0.02–0.1 | 1–6 | 10°–50° |

All notations in Table 1 correspond to the notations shown in FIG. 4, where $D_s$ is the diameter of the upstream end of swirl chamber 20, $L_s$ is the length of swirl chamber 20, $d_o$ is the exit diameter of liquid fuel tip 16, $l_o$ is straight exit length 22 of liquid fuel tip 16 disposed downstream of swirl chamber 20, $d_s$ is the diameter of individual axial-tangential borings 21 in spinner 17, and $\alpha_s$ is the tangential-axial angle formed by axial-tangential borings 21 in spinner 17 and longitudinal axis 32 of liquid fuel tip 16.

As shown in Table 1, for a range of firing rates from about 4.4 to about 130 gallons of fuel oil per hour, the dimensions of liquid fuel tip 16 remain unchanged. However, to match the liquid fuel flow capacity, various spinners 17 having the appropriate diameter ($d_s$) and number of axial-tangential borings 21 are used. The ratio ($D_s/d_o$) is chosen to provide a desired swirl chamber 20 geometry. The magnitude of this ratio determines rotational strength of the liquid fuel film inside the swirl chamber. The higher the ratio, the higher is the rotational speed of the liquid fuel film and the smaller is the film thickness of liquid fuel exiting liquid fuel tip 16. A thinner fuel film atomizes more readily than a thicker film and has a relatively smaller droplet size distribution. Based on the results of our experimentation, the preferred ratio ($D_s/d_o$) is in the range of about 2 to about 4.

Similarly, regarding axial-tangential angle $\alpha_s$, a larger angle provides a relatively higher tangential velocity and smaller axial velocity, resulting in a thinner liquid fuel film at the exit, which in turn produces a smaller droplet size distribution. On the other hand, a smaller angle provides a relatively smaller tangential velocity and larger axial velocity, resulting in a thicker liquid fuel film at the exit, which in turn produces a larger droplet size distribution. Based on the results of our experimentation, the preferred axial-tangential angle, $\alpha_s$, is in the range of 10° to about 50°.

The ratio $L_s/D_s$ is selected based on experiments with various length liquid fuel tips 16. $L_s/D_s$ ratio greater than about 2 results in a greater frictional resistance to liquid fuel film development. A poorly formed and uneven film collapses resulting in a solid jet exiting liquid fuel tip 16 rather than a hollow cone which is easier to atomize. The preferred ratio, $L_s/D_s$, is in the range of about 1 to about 2.

The diameter $d_o$ of straight exit length 22 of liquid fuel tip 16 is selected based on the maximum liquid fuel capacity expected out of liquid fuel tip 16 and prefilming characteristics of swirl chamber 20. At a maximum liquid fuel flow capacity, the film leaving liquid fuel tip 16 in the form of hollow cone 31 must have sufficient cross-sectional area to sustain the spinning action which is due to the existence of a hollow core at the center. The diameter, $d_o$, must be large enough to accommodate this pre-filming activity without physical interference with itself while spinning.

The diameter $D_s$ of swirl chamber 20 is based on swirl characteristics of the liquid fuel, the external diameter of spinner 17, axial-tangential angle $\alpha_s$, the overall size of the burner for compactness and its application to high temperature furnaces. Too large a burner external dimension may receive excessive furnace radiation.

The diameter $D_o$ of venturi 18 is based on the amount of atomizing fluid required at the maximum firing rate. However, by movement of liquid fuel tip 16 within venturi 18, the effective area of annular ring 26 at atomizing fluid outlet end 15 of atomizing fluid tubular member 11 is varied to provide the desired liquid fuel atomization and flame characteristics.

Figure 5:
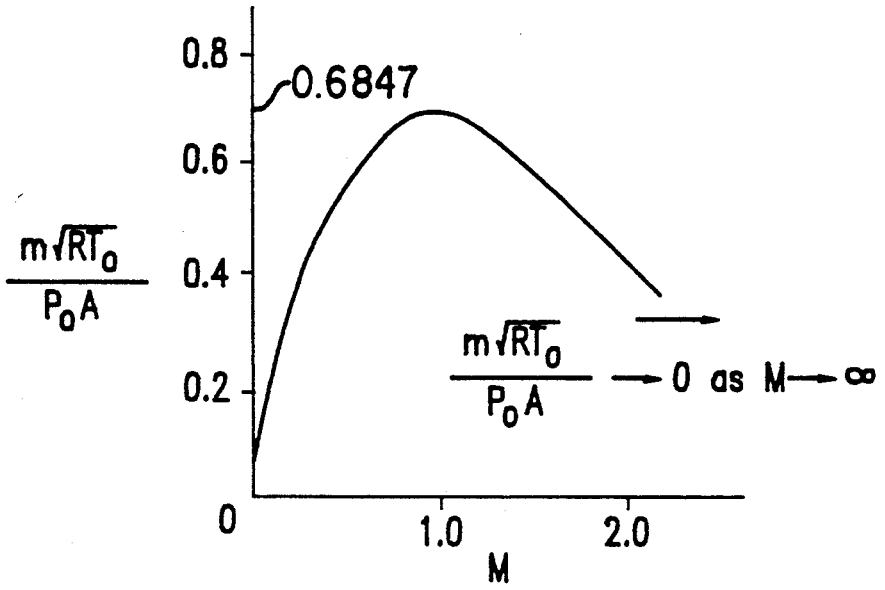
FIG. 5 is a graphic depiction of the dimensionless mass flow function versus Mach number for atomizing air exiting a venturi of a liquid fuel burner.

Known fixed area atomizers used with most liquid fuel injection systems utilize compressed air or other atomizing media up to about 80 psig for atomization. The compressed air is expanded through a critical area, a single or multi-hole geometry around a fuel injection port, to achieve a high velocity jet. This high velocity jet generally impacts the liquid fuel jet at a certain angle to break it up into small droplets suitable for combustion. Due to a fixed nozzle area, an optimum atomizing performance at a given mass flow rate is achieved only for a given total pressure and temperature. As shown in FIG. 5, at a sonic velocity, that is, Mach No. = 1, the dimensionless mass flow function ($m\sqrt{RT_o}/P_oA$) is 0.6847 for air where $R = 1717\ ft^2/sec^2\ {}^oR$ gas constant. As long as this function is maintained at 0.6847, the velocity of atomizing fluid at annular ring 26 of venturi 18 remains sonic.

Figure 6:
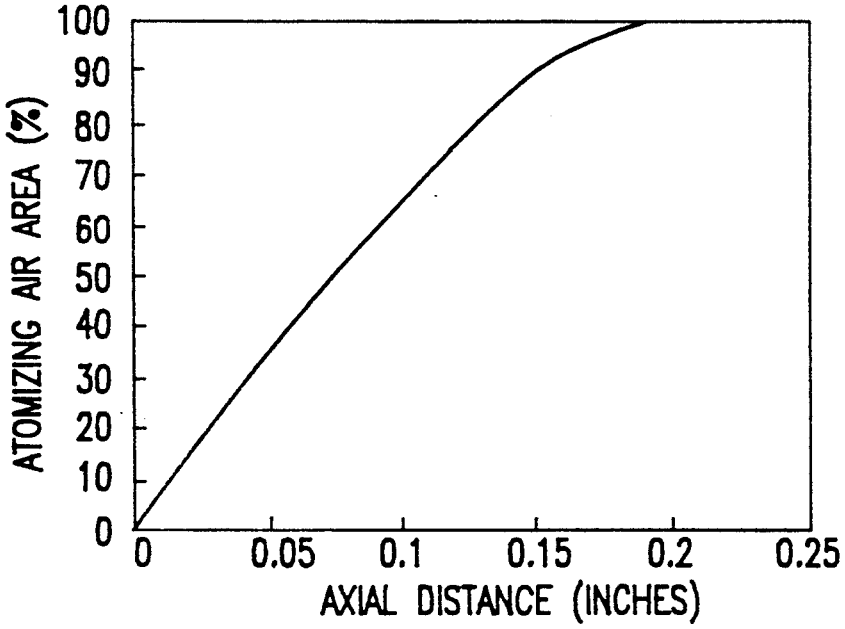
FIG. 6 is a graphic diagram showing the relationship between atomizing air area and axial movement of the liquid fuel tip in the venturi in accordance with one embodiment of this invention.

For most combustion heated furnaces operating under partial load conditions, a reduced firing rate is required. At the reduced liquid fuel consumption, for a liquid fuel fired furnace, a proportional reduction in atomizing medium flow rate (m) to the burner is usually desirable. However, as shown in FIG. 6, any decrease in the dimensionless mass flow function from the 0.6847 value also decreases the atomizing fluid velocity at the fixed annular ring 26 area. This, in turn, generally results in an inefficient atomization of the liquid fuel, affecting both flame and process characteristics. In accordance with the adjustable atomizing liquid fuel burner of this invention, the area of annular ring 26 is adjusted by moving liquid fuel tip 16 into or out of venturi 18. Therefore, the area of annular ring 26 can be set for the desired atomization performance depending on the selection of atomizing fluid mass flow rate and the availability of atomizing fluid pressure.

Thus, the two distinct variable flame characteristic mechanisms provided by this invention provide manual control of the fuel spray pattern exiting liquid fuel tip 16 and adjustment of the annular ring 26 area for the desired performance. Annular ring 26 can be varied by using adjustment mechanism 28, enabling liquid fuel tip 16 to retract in and out of venturi 18, thereby changing annular ring 26 area. FIG. 6 shows the variation in area of annular ring 25 using air as an atomizing fluid from a totally closed position to a fully open position as a function of axial distance travelled by liquid fuel tip 16 as it is retracted from venturi 18. In accordance with one embodiment of this invention, it is provided that annular ring 26 is never completely closed, the smallest area of annular ring 26 providing sufficient atomizing air for safety reasons. Thus liquid fuel injection inside the combustion zone of a furnace without atomizing air is prohibited. In accordance with a preferred embodiment of this invention, the area of annular ring 26 is adjustable between about 0.003 square inches to about 0.6 square inches for various atomizing fluids.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. An adjustable atomizing liquid fuel burner comprising:

a liquid fuel tubular member having a fuel inlet end and a fuel outlet end;

an atomizing fluid tubular member concentrically disposed around said liquid fuel tubular member forming an annular chamber around said liquid fuel tubular member, said atomizing fluid tubular member having an atomizing fluid inlet end and an atomizing fluid outlet end, said atomizing fluid outlet end forming a venturi;

a liquid fuel tip sealingly connected to said fuel outlet end, said liquid fuel tip disposed upstream of said atomizing fluid outlet end and having an internal convergence toward said atomizing fluid outlet end;

means for moving said liquid fuel tip in a direction along a longitudinal axis of said liquid fuel tubular member; and a spinner disposed within said liquid fuel tip immediately upstream of said internal convergence, said liquid fuel tip forming a swirl chamber downstream of said spinner and a straight exit length downstream of said swirl chamber.

2. A liquid fuel burner in accordance with claim 1, wherein said liquid fuel tip converges externally toward said atomizing fluid outlet end of said atomizing fluid tubular member.

3. A liquid fuel burner in accordance with claim 1, wherein said liquid fuel tip is adjustable is said longitudinal direction within said venturi.

4. A liquid fuel burner in accordance with claim 1, wherein said spinner comprises a solid member having at least one axial-tangential boring whereby the flow of said liquid fuel is converted from an axial flow upstream of said spinner to an axial-tangential flow downstream of said spinner.

5. A liquid fuel burner in accordance with claim 4, wherein said solid member comprises 1 to 6 axial-tangential borings.

6. A liquid fuel burner in accordance with claim 5, wherein the diameter of said axial-tangential borings is between about 0.02 to about 0.10 inches.

7. A liquid fuel burner in accordance with claim 5, wherein the angle formed by the longitudinal axis of each said axial-tangential boring and said longitudinal axis of said liquid fuel tubular member is between about 10° and about 50°.

8. A liquid fuel burner in accordance with claim 1, wherein the ratio of the diameter of the upstream end of said swirl chamber to the diameter of the downstream end of said swirl chamber is between about 2 to about 4, the ratio of the length of the swirl chamber to the diameter of the upstream end of said swirl chamber is between about 1 to about 2, and the ratio of said straight exit length of said liquid fuel tip to the diameter of the downstream end of said swirl chamber is about between about 0.1 to about 0.2.

9. A liquid fuel burner in accordance with claim 3, wherein the cross-sectional area of an atomizing fluid annular ring formed by said liquid fuel tip within said venturi is between about 0.003 to about 0.6 square inches.

* * * * *